US007384378B2

(12) United States Patent
Chen

(10) Patent No.: US 7,384,378 B2
(45) Date of Patent: Jun. 10, 2008

(54) TWIST PEDALS FOR STEPPING EXERCISERS

(76) Inventor: Tsung-Yu Chen, No. 23-4, Ting-Liao, San-Ho Tsun, Shiu-Shang Hsiang, Chiayi Hsien (TW)

( * ) Notice: Subject to any disclaimer, the term of this patent is extended or adjusted under 35 U.S.C. 154(b) by 714 days.

(21) Appl. No.: 10/916,496

(22) Filed: Aug. 12, 2004

(65) Prior Publication Data

US 2006/0035756 A1 Feb. 16, 2006

(51) Int. Cl.
*A63B 22/04* (2006.01)

(52) U.S. Cl. ..... 482/53

(58) Field of Classification Search ..... 482/51–53
See application file for complete search history.

(56) References Cited

U.S. PATENT DOCUMENTS 5,628,709 A * 5/1997 Chen ..... 482/53
5,888,175 A * 3/1999 Chang ..... 482/53
6,224,515 B1 * 5/2001 Chen ..... 482/53
6,709,367 B1 * 3/2004 Liang ..... 482/53
6,918,857 B2 * 7/2005 Chen ..... 482/53
7,041,037 B2 * 5/2006 Huang ..... 482/53
2005/0227818 A1 * 10/2005 Liao ..... 482/53

* cited by examiner

*Primary Examiner*—Stephen R. Crow
(74) *Attorney, Agent, or Firm*—Banger Shia

(57) ABSTRACT

A stepping exerciser includes two pedals each have a tube connected to an end thereof at an angle and the two respective tubes are rotatably mounted to two inclined tubes on a front post of the exerciser. The two pedals are respectively connected to two cylinders. The two pedals are pivoted about the two inclined bars alternatively and the pedals are moved downward and outward to act as a twist action.

5 Claims, 6 Drawing Sheets

TWIST PEDALS FOR STEPPING EXERCISERS

FIELD OF THE INVENTION

The present invention relates to a stepping exerciser which includes two pedals pivotable about two inclined bar so as to perform twist action.

BACKGROUND OF THE INVENTION

A conventional stepping exerciser generally includes a H-shaped base with two pedals and each pedal has one end pivotably connected to the frame and a resistance device such as a hydraulic cylinder is connected to each pedal such that the user has to overcome the resistance of the cylinders to step down the pedals alternatively. Usually, the pedals can only stepped downward vertically and the user's body is maintained in upright pose. This limitation makes the exercise to be boring and spend less time on the exerciser. Besides, the straight up and down actions reinforce the muscles of the legs, but cannot exercise the waist where fat is accumulated.

The present invention intends to provide a stepping exerciser wherein the trace of the pedal includes up-and-down and twist, the actions of the pedals provide more exercises for different parts of the body.

SUMMARY OF THE INVENTION

The present invention relates to a stepping exerciser that comprises a H-shaped base having a front post extending therefrom and a rod extends through the front post and includes two inclined bars extending inclined and upward relative to the front post. Two pedals each have a tube connected to an end thereof and the two respective tubes are rotatably mounted to the two inclined bars. The tube is transversely connected to the pedal and an angle is defined between a plane in which the pedal is located and a plane where a longitudinal axis of each of the tubes is located. The other end of each of the two pedals is connected to a first end of one of two cylinders, a second end of each of the two cylinders is connected to the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
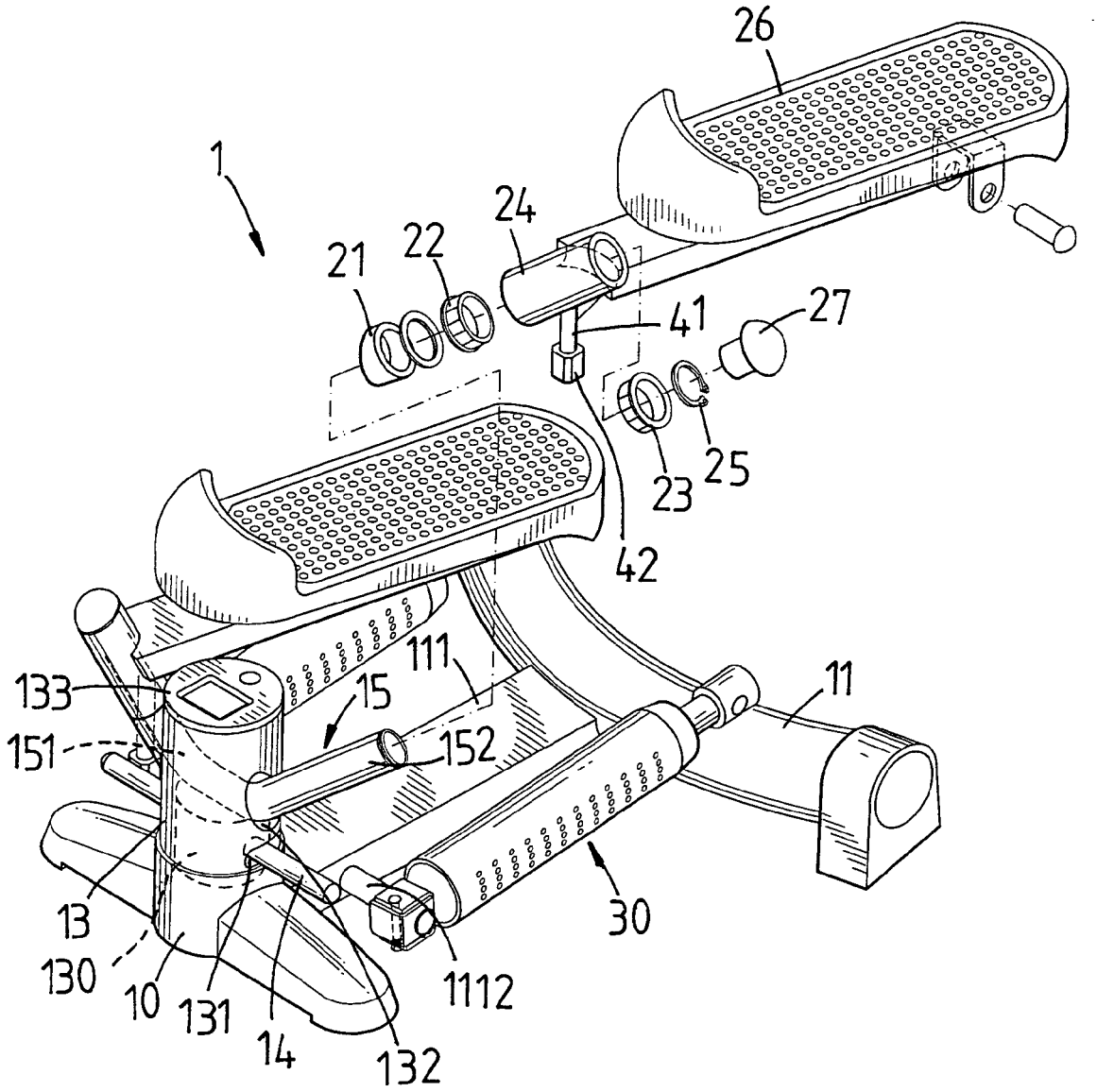
FIG. 1 is an exploded view to show one of the two pedals and the stepping exerciser of the present invention.
Figure 2:
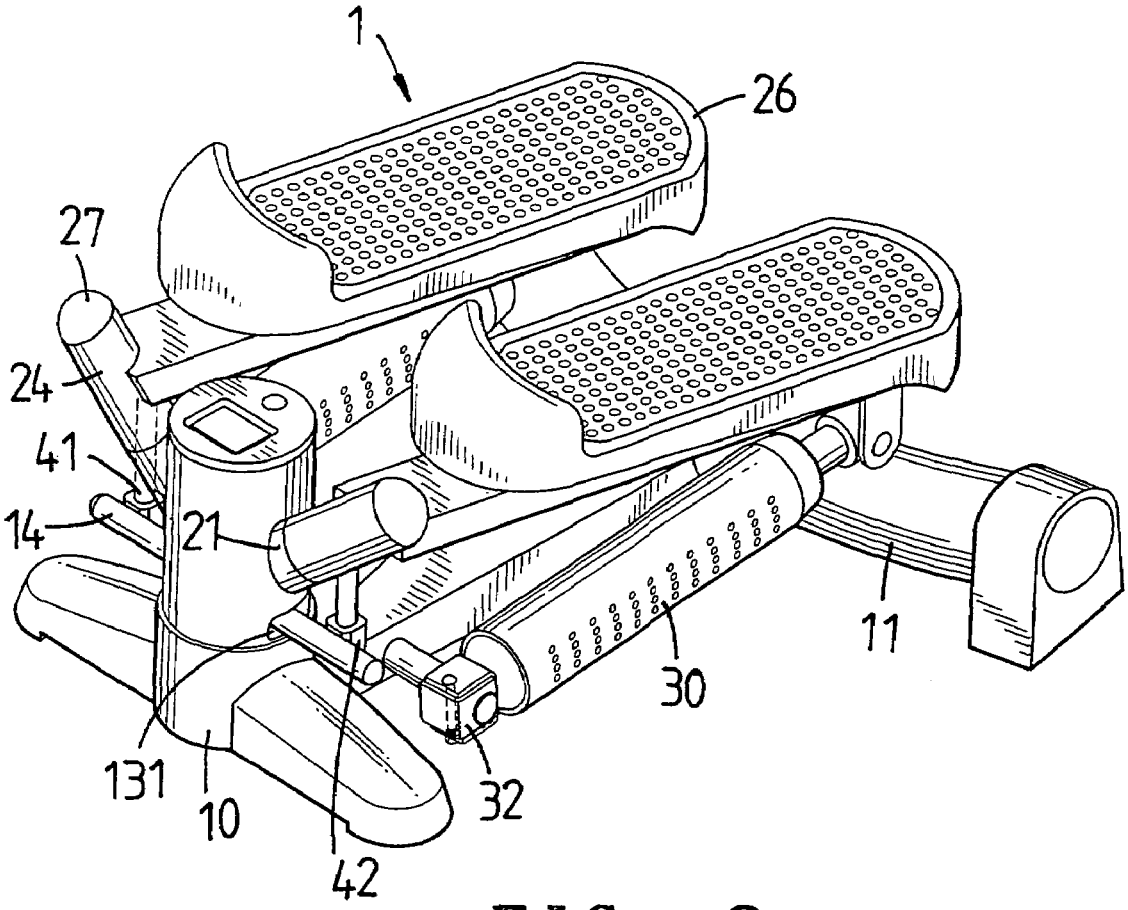
FIG. 2 is a perspective view to show the stepping exerciser of the present invention.
Figure 3:
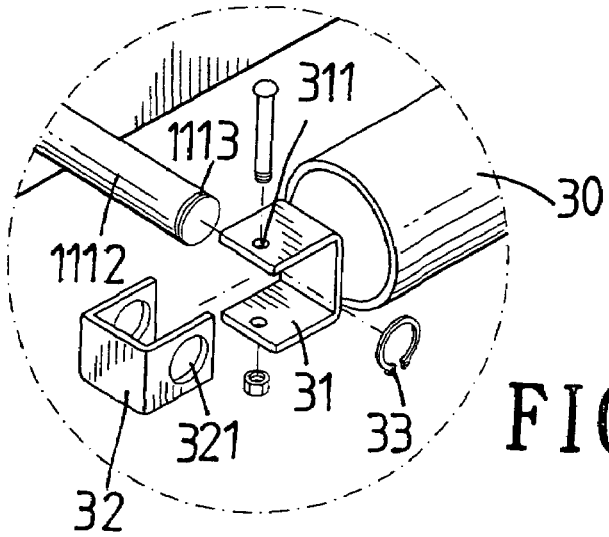
FIG. 3 is an exploded view of the universe joint for connecting the cylinder and the side rod.
Figure 4:
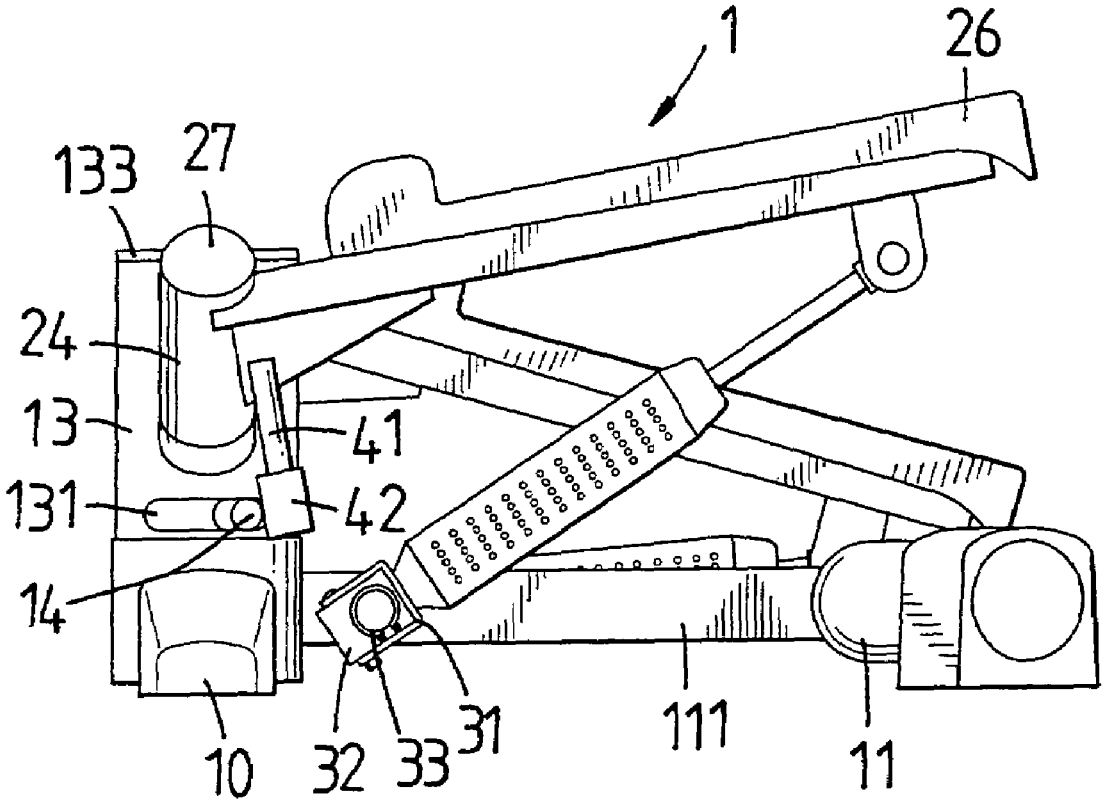
FIG. 4 is a side view of the stepping exerciser of the present invention.
Figure 5:
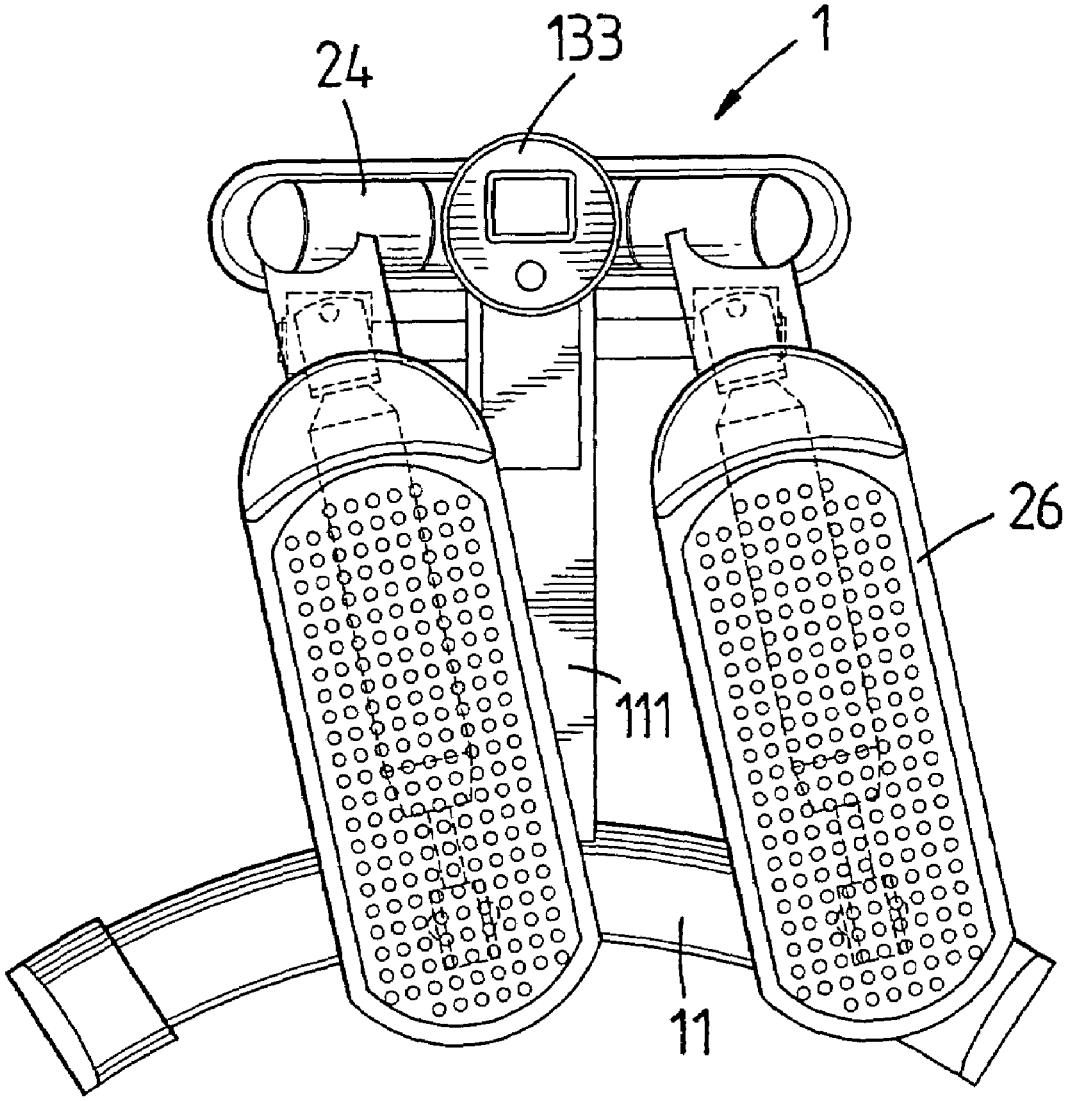
FIG. 5 is a top view to show the stepping exerciser of the present invention.

Referring to FIGS. 1, 2, 4 and 5, the stepping exerciser 1 of the present invention comprises an H-shaped base that includes a front portion 10, a rear portion 11 and a connection portion 111 connected between the front and rear portions 10, 11. A front post 13 extends from the front portion 10 and includes a rotatable member 130 received therein. A passage 132 is defined transversely through the front post 13 and a rod 15 extends through the passage 132. The rod 15 includes a horizontal section 151 retained in the passage 132 and two inclined bars 152 which extend inclined and upward relative to the front post 13. The front post 13 includes a slot 131 defined therethrough and a limitation bar 14 has its middle portion connected to the rotatable member 130 and extends through the slot 131.

Two pedals 26 each have a tube 24 connected to an end thereof and the two respective inclined tubes 24 are rotatably mounted to the two inclined bars 152. The tube 24 is transversely connected to the pedal 26 and an angle is defined between a plane in which the pedal 26 is located and a plane where a longitudinal axis of each of the tubes 24 is located. Two adaptor rings 21 are respectively mounted to the inclined bars 152 and each adaptor ring 21 has an inclined end which is in contact with an outer periphery of the front post 13. Two positioning rings 22, 23 are respectively engaged with two open ends of each tube 24 by two clips 25 (only one is shown), the positioning ring 22 is connected to a flat end opposite to the inclined end of the adaptor ring 21. An end member 27 is inserted through the positioning ring 23 and seals the open end of the tube 24. The other end of each of the two pedals 26 is connected to a first end of one of two cylinders 30, a second end of each of the two cylinders 30 is connected to the base.

The second end of each of the two cylinders 30 is connected to a universe joint and a side rod 1112 extends from the connection portion 111 of the base, the universe joint is connected between the second end of the pedal 26 and the side rod 1112. The universe joint includes a first U-shaped frame 31 which is connected to the second end of each of the cylinders 30 and includes two first side plates. Each first side plate having a pin hole 311. A second U-shaped frame 32 has two second side plates which are located in alternative with the first side plates of the first U-shaped frame 31. Each second side plate has a through hole 321 and the side rod 1112 extends through the two through holes 321 in the two second side plates. A pin extends through the two pin holes 311 in the first side plates and the side rod 1112 which has a groove 1113 with which a clip 33 is engaged to prevent the second U-shaped frame 32 from disengaging from the side rod 1112. Therefore, the second end of each cylinder 30 is able to swing in different directions during use.

Figure 6:
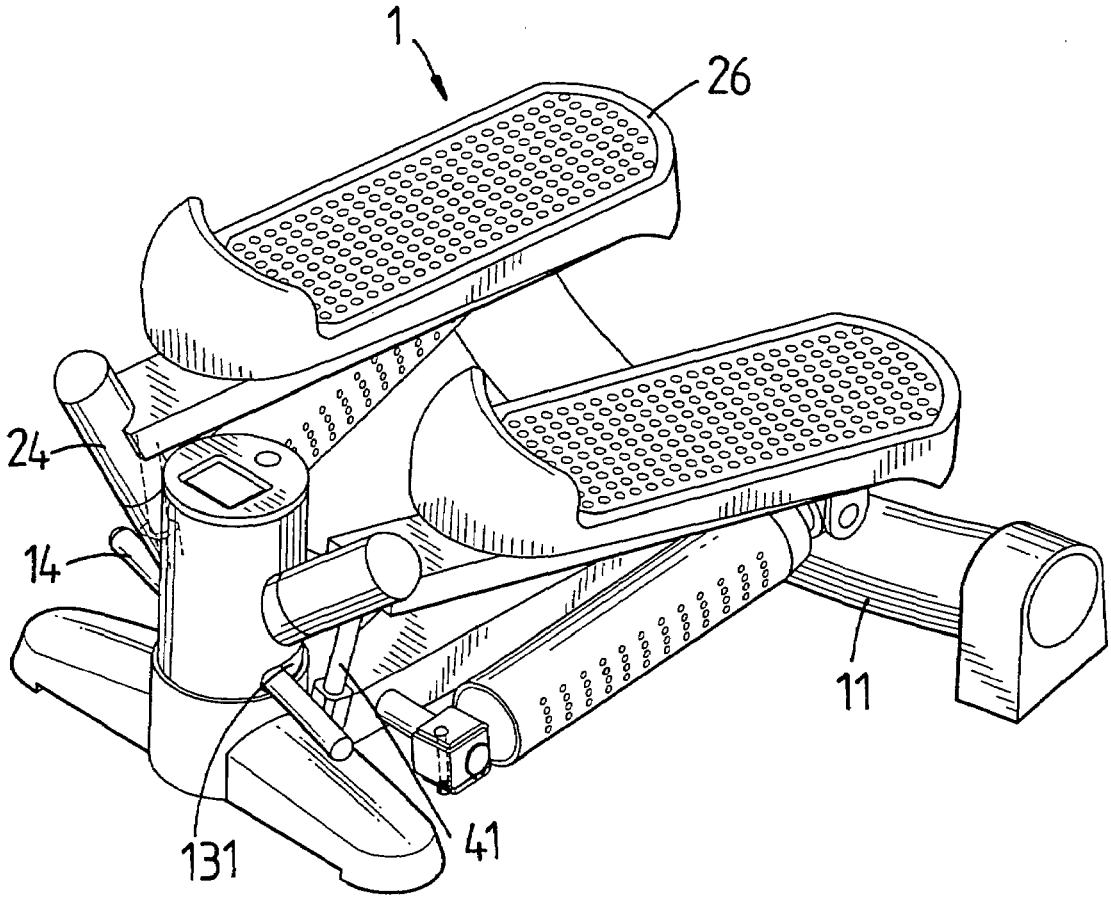
FIG. 6 shows that the pushing rod is engaged with the limitation rod when using the stepping exerciser of the present invention.

Each pedal 26 has an extension rod 41 extending from an underside thereof and a pushing member 42 which is a polygonal block is connected to the extension rod 41. The two respective pushing members 42 are respectively engaged with two ends of the limitation bar 14. As shown in FIG. 6, when one of the pedals 26 is stepped downward, the pedal 26 is pivotable about the inclined bar 152 and the pushing member 42 pushes the limitation bar 14 till the limitation bar 14 moves to an end of the slot 131. The movement of the limitation bar 14 provides a twist action for the user when using the stepping exerciser. A display member 133 is connected on a top of the front post 13 to provide physical and exercising data to the users.

Figure 7:
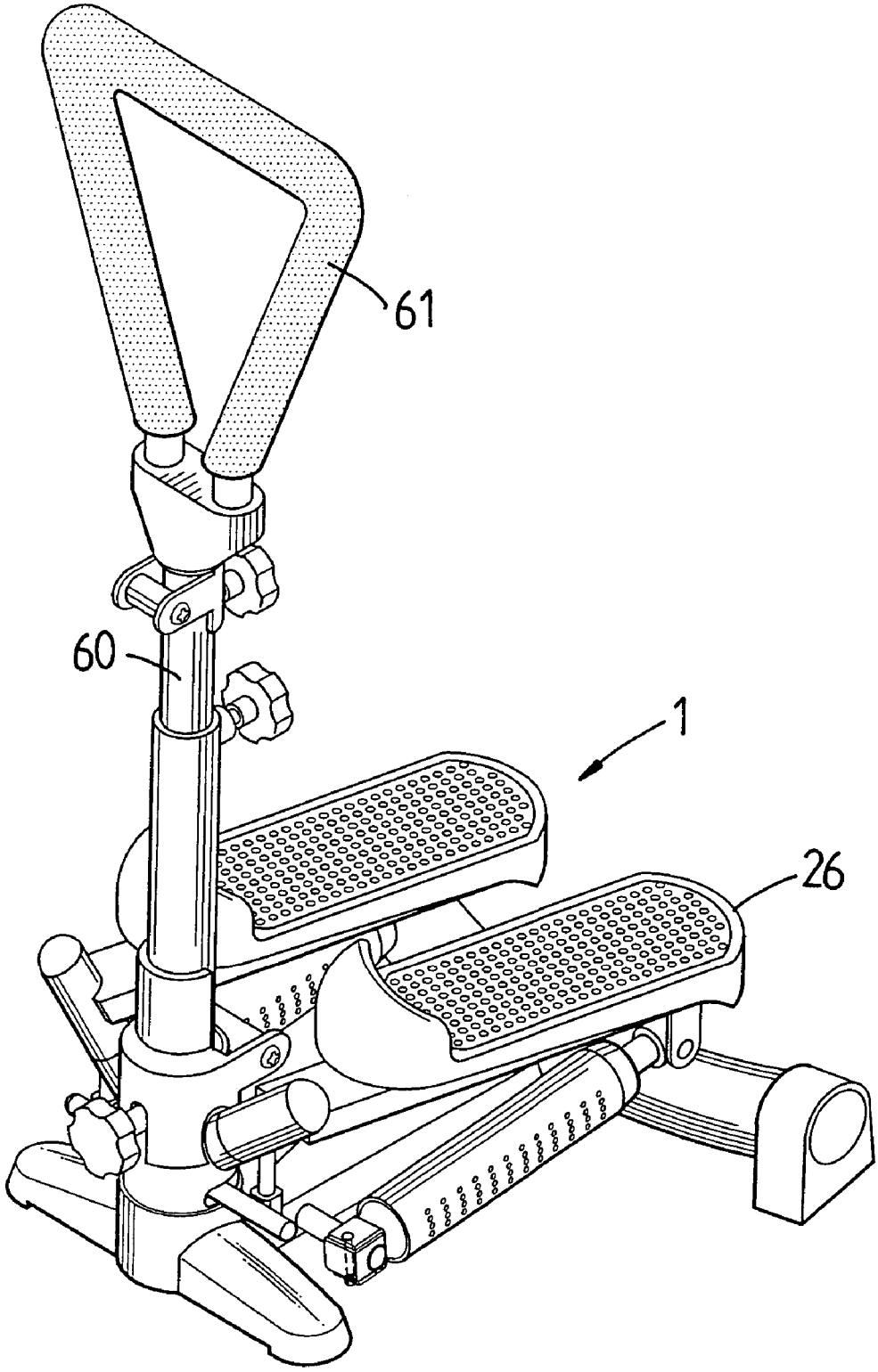
FIG. 7 shows that the stepping exerciser of the present invention includes a retractable post and a handle.

Referring to FIG. 7, the front post 13 is connected to a retractable post 60 and a handle 61 is connected to the retractable post 60.

While we have shown and described the embodiment in accordance with the present invention, it should be clear to those skilled in the art that further embodiments may be made without departing from the scope of the present invention.

What is claimed is:

1. A stepping exerciser comprising:

a base having a front post extending therefrom and a passage defined transversely through the front post;

a rod extending through the passage and including a horizontal section retained in the passage and two inclined bars extending obliquely and upward relative to the front post;

two pedals each having a tube connected to an end thereof and mounted on a related one of the inclined bars so that an angle is defined between a plane in which the pedal is located and a plane where a longitudinal axis of each of the tubes is located;

two cylinders each comprising an end connected to another end of a related one of the pedals;

two side rods extending from the base; and two universal joints each comprising:

a first U-shaped frame connected to another end of a related one of the cylinders and formed with two side plates each comprising a pin hole defined therein;

a second U-shaped frame comprising two side plates arranged alternately with the side plates of the first U-shaped frame and each formed with a through hole for receiving a related one of the side rods; and a pin extending through the pin holes of the side plates of the first U-shaped frame and a related one of the side rods.

2. The stepping exerciser as claimed in claim 1 further comprising two adaptor rings respectively mounted to the inclined bars and each adaptor ring has an inclined end which is in contact with an outer periphery of the front post, two positioning rings respectively engaged with two open ends of each tube, one of the positioning rings connected to an end opposite to the inclined end of the adaptor ring.

3. The stepping exerciser as claimed in claim 1, wherein the front post includes a slot defined therethrough and a limitation bar is connected to a rotatable member located in the front post and extends through the slot, each pedal having a pushing member connected to an underside thereof and the two respective pushing members respectively engaged with two ends of the limitation bar.

4. The stepping exerciser as claimed in claim 3, wherein each of the pushing members is a polygonal block and is connected to an extension rod extending from the pedal.

5. The stepping exerciser as claimed in claim 1, wherein the front post is connected to a retractable post and a handle is connected to the retractable post.

* * * * *